US009445180B1

(12) United States Patent
Tite

(10) Patent No.: US 9,445,180 B1
(45) Date of Patent: Sep. 13, 2016

(54) METHOD OF STORING HEADPHONES

(71) Applicant: Christopher Max Tite, Andover, MN (US)

(72) Inventor: Christopher Max Tite, Andover, MN (US)

( * ) Notice: Subject to any disclaimer, the term of this patent is extended or adjusted under 35 U.S.C. 154(b) by 0 days.

(21) Appl. No.: 14/735,788

(22) Filed: Jun. 10, 2015

Related U.S. Application Data

(60) Provisional application No. 62/010,547, filed on Jun. 11, 2014.

(51) Int. Cl.
*H04R 1/00* (2006.01)
*H04R 1/10* (2006.01)

(52) U.S. Cl.
CPC ..... *H04R 1/1033* (2013.01)

(58) Field of Classification Search
CPC ..... H04R 1/1033; H04R 2201/107
USPC ..... 381/384
See application file for complete search history.

(56) References Cited

U.S. PATENT DOCUMENTS

| | | | | | |
|---|---|---|---|---|---|
| D571,192 | S * | 6/2008 | Stomp | D8/356 | |
| D712,372 | S * | 9/2014 | Rajski | D14/205 | |
| D712,373 | S * | 9/2014 | Rajski | D14/205 | |
| 2005/0123164 | A1* | 6/2005 | Yao | H04M 1/15 | 381/380 |
| 2011/0317865 | A1* | 12/2011 | Stevinson | H04R 1/1033 | 381/384 |

* cited by examiner

*Primary Examiner* — Jesse Elbin
*Assistant Examiner* — Julie X Dang
(74) *Attorney, Agent, or Firm* — Moss & Barnett; Michael A. Bondi

(57) ABSTRACT

A headphone storage system that includes a headphone and a headphone storage device. The headphone includes a speaker, a cord and a plug. The cord extends from the speaker. The plug is attached to an end of the cord that is opposite the speaker. The headphone storage device includes a main body portion having a first end and a second end. The headphone storage device has a first aperture and a second aperture formed therein. The first aperture and the second aperture both permit the cord and the plug to pass therethrough.

7 Claims, 7 Drawing Sheets

METHOD OF STORING HEADPHONES

REFERENCE TO RELATED APPLICATION

This application claims priority to U.S. Provisional Application No. 62/010,547, which was filed on Jun. 11, 2014, the contents of which are incorporated herein by reference.

FIELD OF THE INVENTION

The invention generally relates to a storage system. More particularly, the invention relates to headphone storage system and a method of storing headphones.

BACKGROUND OF THE INVENTION

The use of headphone sets, earphone devices, earbud devices, and other cord-connection devices designed to convey sound from an electronic device to one or both ears such as cellphones and portable music players is widely in use today.

Along with this prolific usage, a common issue and annoyance that people frequently experience with such headphone/earbud devices is that the cords tend to tangle. This seems to be the most prevalent complaint people make about earbuds.

Fortunately, a number of devices are already in use today (the state of the technology) to assist users with this issue. Unfortunately, current attempts to solve the chronic tangled cord problem invariably fall short in many ways, not the least of which is that they don't always actually solve the problem. They might solve part of it, but everyone knows tangled cord is devious and persistent.

Some devices store cords by providing a way to wrap them up. This is only the beginning! The best solution to tangled cord is to do more. This ultimate solution does many things: 1. It helps you wrap the cord, rapidly and smoothly. 2. It provides a means to let you store the wrapped cord, conveniently and portably. 3. Importantly, it lets you unwrap that cord as quickly and neatly as possible. 4. Just when that earbud cord is achieving its best and highest goal in life, then, the ultimate solution lets you keep your cord detangler close-best is to keep it attached to the cord so it is always handy and ready to re-wrap, before the tangling even starts.

Many current devices are oriented to storing the earbuds or headphones in such a way that they are orderly and tangle-free. By design when they are not performing the storage function, they can be separated from the earbuds or headphones. The parts may get lost or misplaced just when they're needed if they are not all attached to the cord at all times. At minimum, they must be kept at hand when not in use.

Some current devices (or their component pieces) might be small enough to be swallowed, which could certainly be problematic. If too large to be swallowed, they may not fit easily in a pocket, or they may not be nearly as lightweight and compact.

In order to be wearable, most current devices may have to be attached to the user's shirt or arm using loops, hooks, clips, clasps, or other coupling devices. This may require positioning, fitting, screwing, snapping or clipping actions, taking more time and thought to use.

Likewise, if the current devices are to be connected directly to the cord, the same issues of attachment often apply. Most current devices require manual cord unwrapping rather than designed automatic unwrapping, so they are not designed to be unwrapped and deployed as quickly.

Most current designs do not benefit from a recommended method or process for use which expedites both the wrapping and unwrapping phases of use as well as storage. Some current device designs may involve covering or reinforcing portions of the cord, making the earbud assembly bulkier.

Some current devices feature relatively non-functional designs such as football shapes, fish shapes, flowers, human or animal faces or body shapes, etc. rather than a design that directly supports the intended functions of cord storage, cord deployment, and cord winding.

To secure the cord to the device, current devices may have cuts or notches on the outside edge(s) that can catch on clothing or other objects if worn. Current devices that have edge cuts or notch-like features are more susceptible to the headphone cord catching on the edge in the unwrapping process, impeding inefficient operation. Current devices may not include capability for the embellishment of imprinting or messaging options, or methods of customization and/or personalization. The present invention, the ultimate solution, addresses each of the above problems satisfactorily, and most importantly, provides a simple and easy way to manage earbud cords to reliably keep them as tangle-free as possible; provides an easy way to quickly wrap up cords for storage and/or transport after use; provides an easy and very fast way to unwrap their cords to use their earbuds or similar devices; provides an integrated, compact, lightweight and portable solution; provides for permanent attachment to the earbuds or headphones so that the device is always presented and accounted for without thought or effort; and provides space for optional ornamental display of pictures, messaging, branding, colors and style, and other information to others like a business card or photo you can wear.

SUMMARY OF THE INVENTION

An embodiment of the invention is directed to a headphone storage system that includes a headphone and a headphone storage device. The headphone includes a speaker, a cord and a plug. The cord extends from the speaker. The plug is attached to an end of the cord that is opposite the speaker. The headphone storage device includes a main body portion having a first end and a second end. The headphone storage device has a first aperture and a second aperture formed therein. The first aperture and the second aperture both permit the cord and the plug to pass therethrough.

Another embodiment of the invention is directed to a method of storing an elongated cord having a first end and a second end. A cord storage device is provided that includes a main body portion having a first aperture formed therein. The first end is extended through the first aperture. The first end is wrapped around the main body portion so that the cord extends over the first end and the second end. The second is wrapped around the main body portion in a direction that is generally transverse to a direction in which the first end was wrapped around the main body portion.

Another embodiment of the invention is directed to a method of storing headphones that include a speaker, a cord and a plug. The cord extends from the speaker. The plug is attached to an end of the cord that is opposite the speaker. The method provides a headphone storage device that includes a main body portion having a first aperture and a second aperture formed therein. The plug and a portion of the cord are extended through the first aperture. The cord is wrapped at least once around the main body portion before extending the plug through the second aperture to reduce a length of the cord. An end of the cord to which the speaker is attached is wrapped around the main body portion so that the cord extends over the first end and the second end. An end of the cord to which the plug is attached is wrapped around the main body portion in a direction that is generally transverse to a direction in which the end of the cord to which the speaker is attached is wrapped around the main body portion.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

DETAILED DESCRIPTION OF THE INVENTION

Terminology

Figure 1:
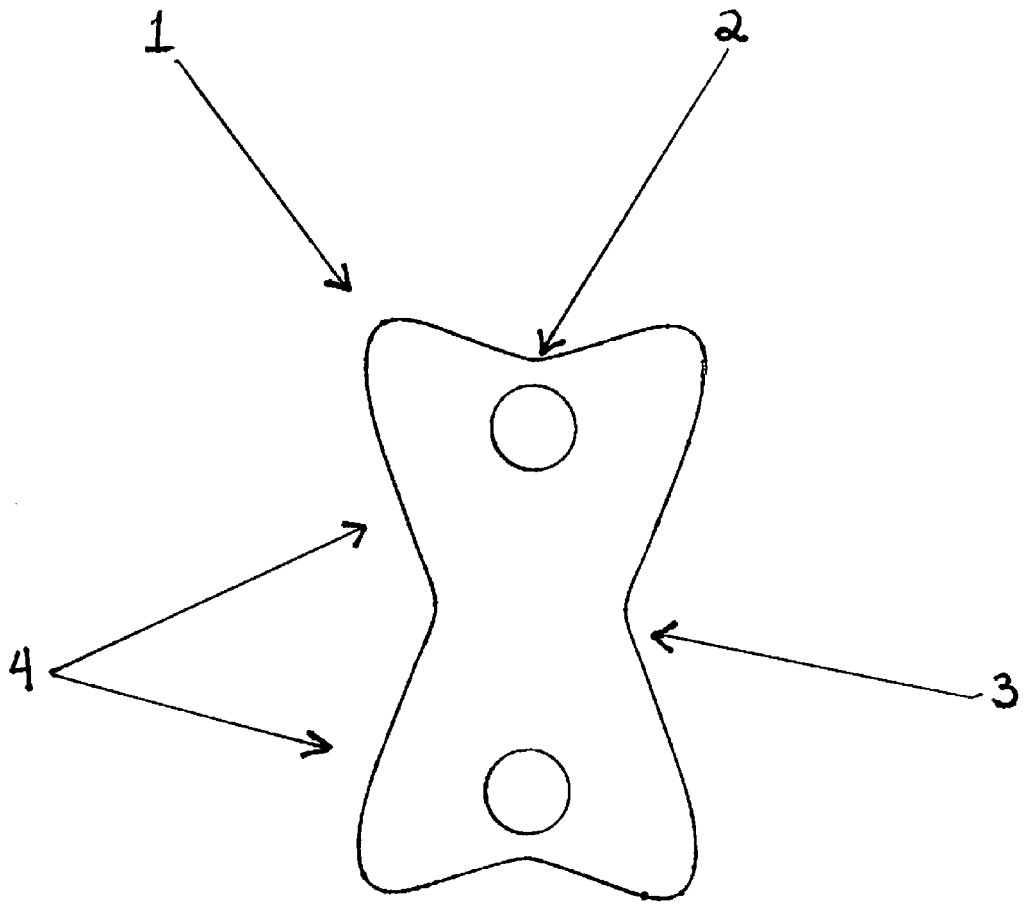
FIG. 1 illustrates a top plan view and/or bottom plan view of an embodiment of the present invention in accordance with some embodiments.
Figure 2:
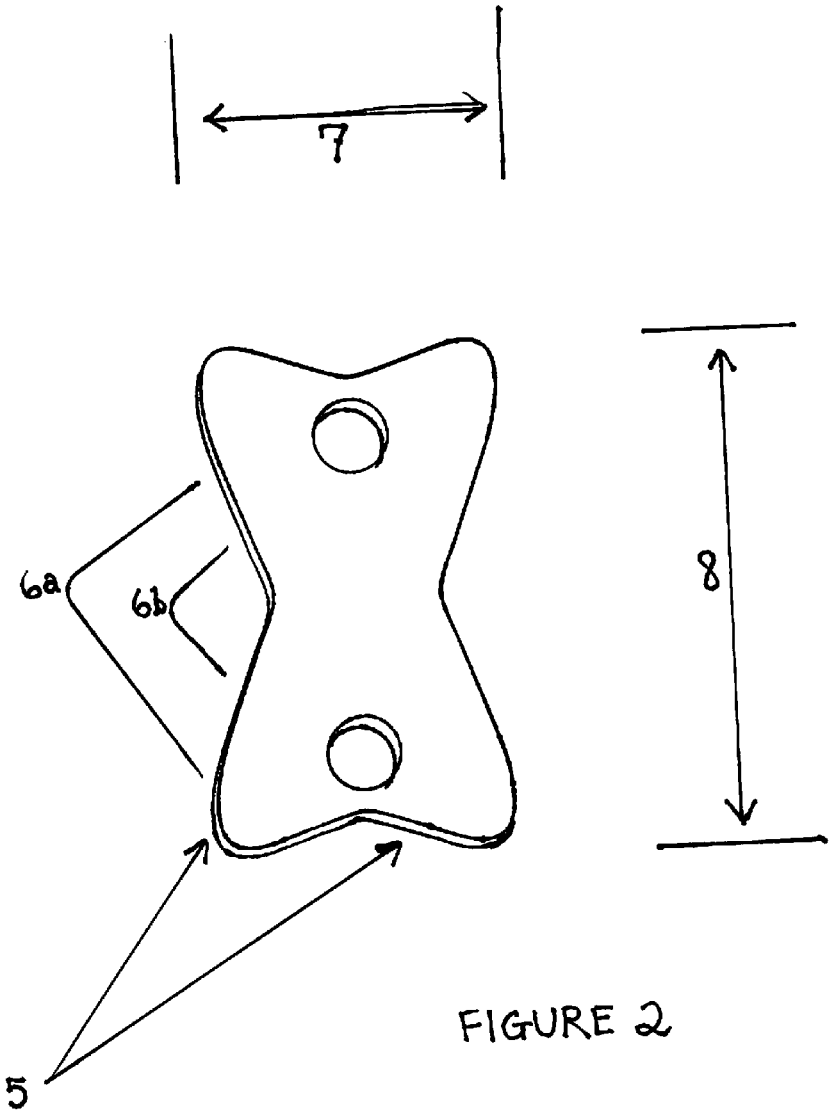
FIG. 2 illustrates a top or bottom plan view of an embodiment of the present invention with side perspective.

The terms and phrases as indicated in quotation marks (" ") in this section are intended to have the meaning ascribed to them in this Terminology section applied to them throughout this document, including in the claims, unless clearly indicated otherwise in context. Further, as applicable, the stated definitions are to apply, regardless of the word or phrase's case, tense or any singular or plural variations of the defined word or phrase.

Directional and/or relational terms such as, but not limited to, left, right, top, bottom, vertical, horizontal, longitudinal, back, front, planar surface and edges are relative to each other and are dependent on the specific orientation of a applicable element or article, and are used accordingly to aid in the description of the various embodiments and are not necessarily intended to be construed as limiting.

The term "or" as used in this specification and the appended claims is not meant to be exclusive rather the term is inclusive meaning "either or both".

References in the specification to "one embodiment", "an embodiment", "a preferred embodiment", "an alternative embodiment", "a variation", "one variation", and similar phrases mean that a particular feature, structure, or characteristic described in connection with the embodiment is included in at least one embodiment of the invention. The appearances of phrases like "in one embodiment", "in an embodiment", or "in a variation" in various places in the specification are not necessarily all meant to refer to the same embodiment or variation.

The term "cord" or any variation thereof, as used in the specification and the appended claims refers to the element or elements associated with the headphone set, or earphone set, or earbud set, or similar such wired audio electronics devices, although in application and use of this invention, the term "cord" is not restricted to a headphone set, or earphone set, or earbud set, but can also be in reference to a USB charger cord or similar electronic device electrical charging cord and its associated components synonymously and in conjunction with regard to connection with the present invention. The term "corded device" or similar terms may be used in reference herein. Any or all of these elements are not a part of the claim of the present invention except as it relates to method or system of use, but are generally used in conjunction with most embodiments of the present invention.

The terms "wrapping", "wrap", "winding", "threading", "passing through" and the like are used in reference to processes claimed herein, where the cord(s) of the unclaimed device(s) are attached and used with the present invention in most but not necessarily all embodiments.

The term "hole" or "holes" as used in this specification and the appended claims refers to one or both of the two openings within the planar surface of the present invention as herein described and as configured in the embodiments as claimed.

The term "couple" or "coupled" or "attached" as used in this specification and the appended claims refers to either an indirect or direct connection between the identified elements, components or objects. Often the manner of the coupling will be related specifically to the manner in which the two coupled elements interact. For example, the cord is connected with the present invention by passing through the holes with ½ or more wraps of the cord around the body of the present invention in either direction, while the cord is also connected with the present invention by wrapping around it in either or both horizontal and vertical directions.

The terms "headphone" or "headphones", "earphone" or "earphones", or "earbud" or "earbuds", or "USB cable" or "cables" are used to denote that corded element, but not any one specific such element or design, since any or all of these corded elements are not a part of the claim of the present invention except as it relates to method and system of use. The terms "assembly" or "set" are used to denote the corded device and/or components as they are attached for purposes of use as described in this application.

The term "object", "earbud holder", and "attachment" in most contexts refer to the physical element of the present invention as described herein, and the term "body" refers to the mid-portion of the object.

The term "integrate" or "integrated" or "integrally" as used in this specification and the appended claims refers to a blending, uniting, or incorporation of the identified elements, components or objects into a unified whole for purposes of use as described in this application.

Description

The present disclosure relates to an attachment for use with a typical headphone cord, or earphone cord, or earbud cord, or other suitable cord. One such cord attachment may be comprised of an ornamental object adapted to couple to a section along the length of the associated cord.

The present invention as disclosed is constructed from one of the following materials: plastic, wood, or cardboard, or derivative materials therefrom. Method of Manufacture: The present invention in all of its embodiments may be manufactured by any of a variety of methods or combination of methods, such as, but not limited to, a stamping manufacturing process, injection molding, heat molding or die cutting, laser cutting, or printing and cutting methods such as those commonly utilized in the commercial production of custom business cards.

Certain aspects of the invention are intrinsic to the invention, as are identified here in the Specifications and Detailed Description. The size and shape characteristics and configuration details of the earbud cord attachment are important components toward ensuring the successful application of the process described as follows:

I. A flat or generally flat object that is generally symmetrical its proportions with respect to the specifications in II. below, having four corners and four sides which are indented (or have a convex shape) from the corners at both sides and at the top and bottom of the object, as shown in FIG. 1, 1 depicting said corner or corners of one embodiment, 2 showing indents at the top and by implication also the bottom, and 3 showing indents at the side and by implication also at the other side. The shape is such that the central portion of the longer sides is indented with respect to the width of the embodiment, and similarly the central portion of the ends is also indented with respect to the length of the embodiment. Thus, the distance along the length edge of the embodiment is shorter in the middle of the width of the embodiment than at the two ends, and the distance along the width edge of the embodiment is shorter in the middle of the length than at the two widths' edges or endpoints.

II. The size of the object of disclosure will in its overall outer edge dimensions fit within a rectangular dimension of approximately 50 millimeters by 90 millimeters, and will be of a thickness of between about one millimeter and six and one half millimeters.

III. The object also has two holes which are entirely contained within the outer edges of the object's surface and do not open to (or intersect) the outer edges, as shown in 4. Such a configuration minimizes catching of the cord or wear on the cord as the cord is moved into or out of the hole through an opening that intersects an edge of the object. Notwithstanding that said holes may vary in size, shape and configuration in contemplated embodiments, each of the two holes will be of sufficient size to enable the phono-type plug end and associated cord of common earbud-type devices to pass through, and both will be generally identical with respect to each other within each embodiment. The embodiment as shown in 5 shows the relative edge thickness as represented in II. above. Based on the thickness and material used in various embodiments of the present invention, the object may exhibit varying degrees of flexibility and/or rigidity. Further, the embodiment as shown in 6*a* shows holes that could be larger, round or oval, oblong, square, etc., and the vertical lines 4 and 6*b* represent cuts or slits made in the material, such that a phono-type plug end or micro USB cord end can be passed through the openings.

IV. 7 is intended to characterize the maximum dimension of width and 8 is intended to characterize the maximum dimension of height as described in I. and II. above.

Figure 3:
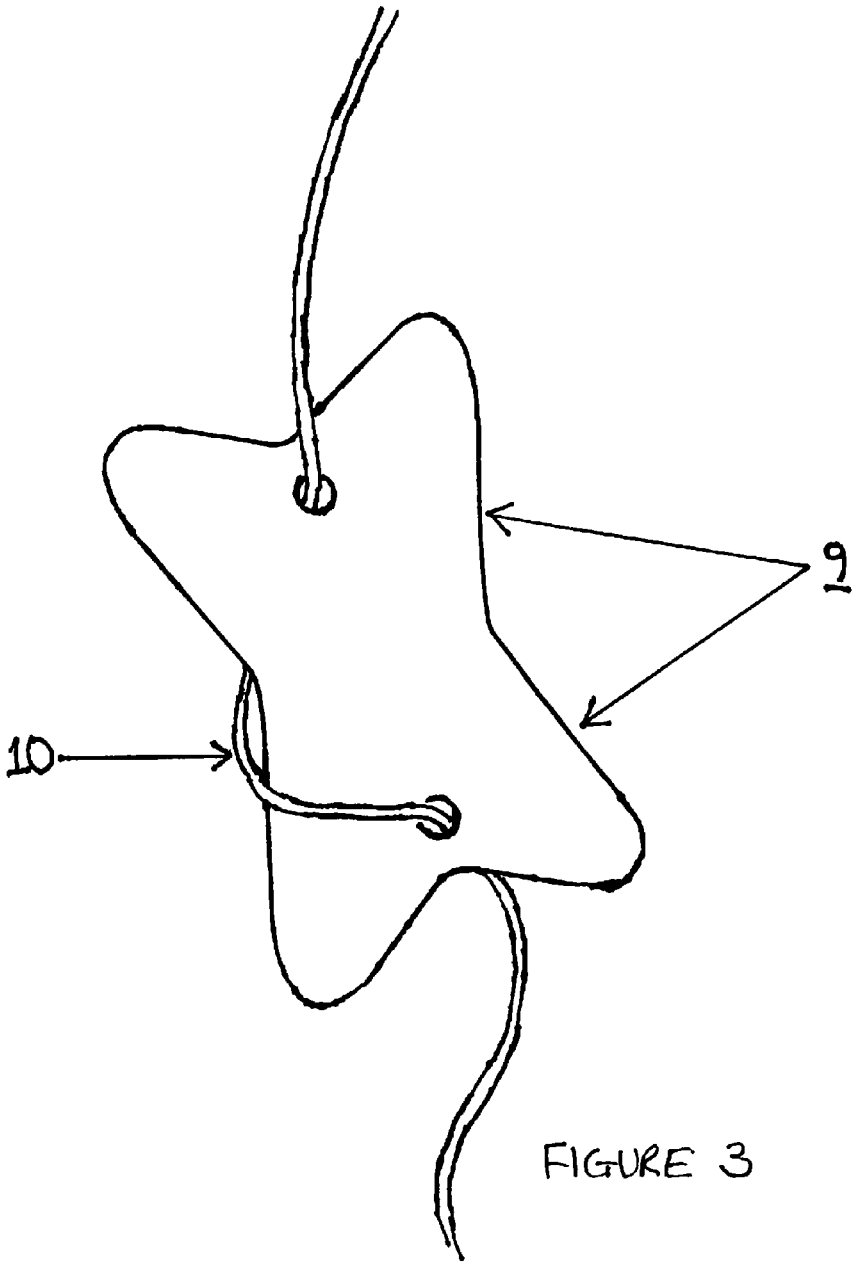
FIG. 3 illustrates an embodiment of the present invention in accordance with some embodiments, showing one method of attachment to the headphone/earphone cord.
Figure 4:
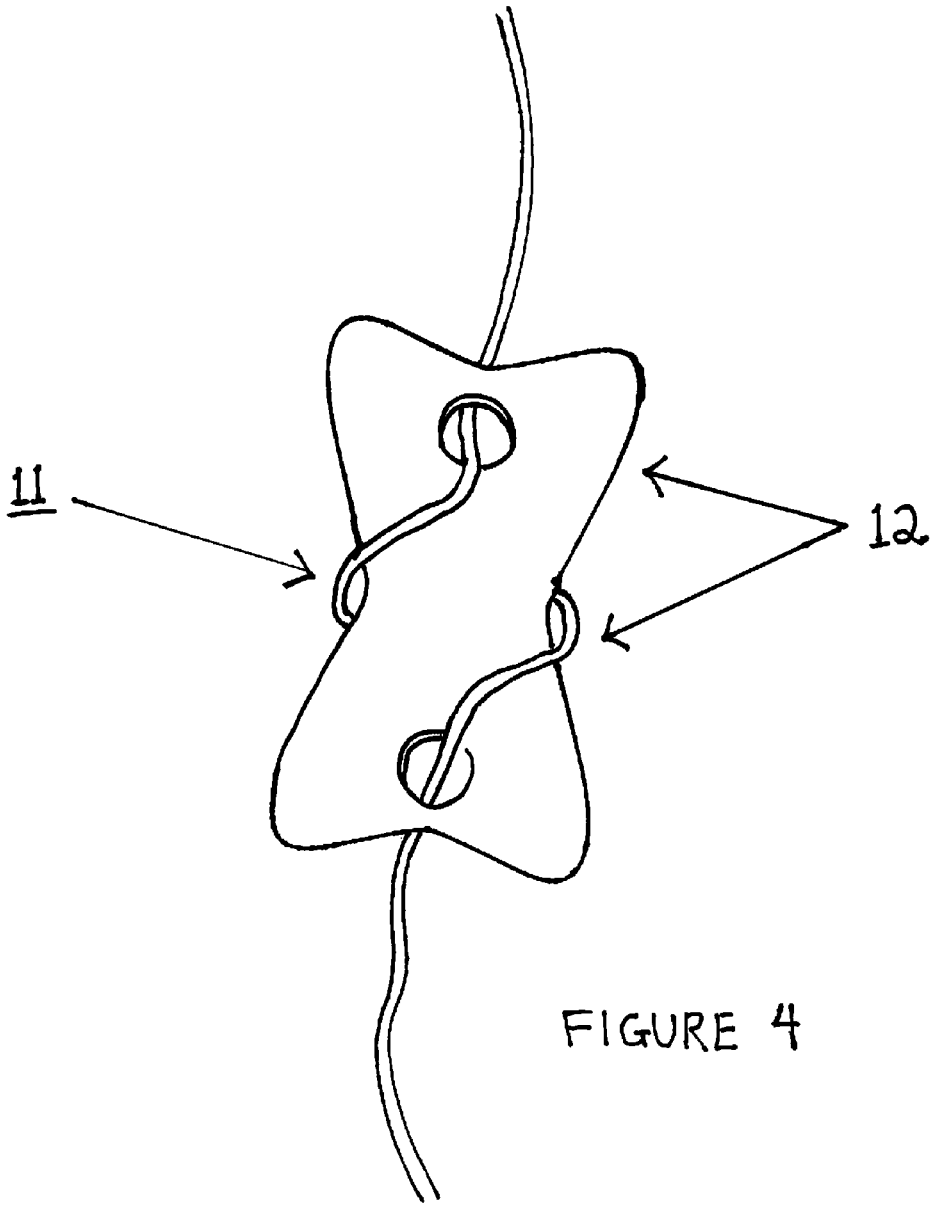
FIG. 4 illustrates an embodiment of the present invention in accordance with some embodiments, showing one alternative method of attachment to the headphone/earphone cord.
Figure 5:
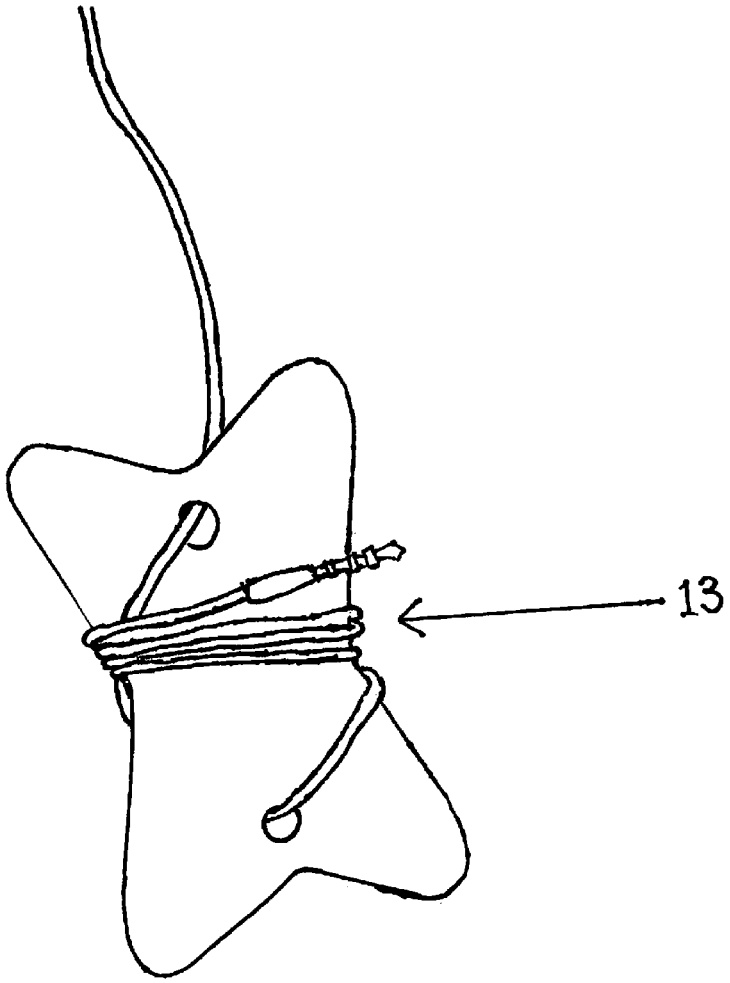
FIG. 5 illustrates an embodiment of the present invention in accordance with some embodiments, showing the headphone/earphone plug end and wire in broken line, and illustrates Part One of one embodiment of the method or system of cord wrapping around the earphone holder.
Figure 6:
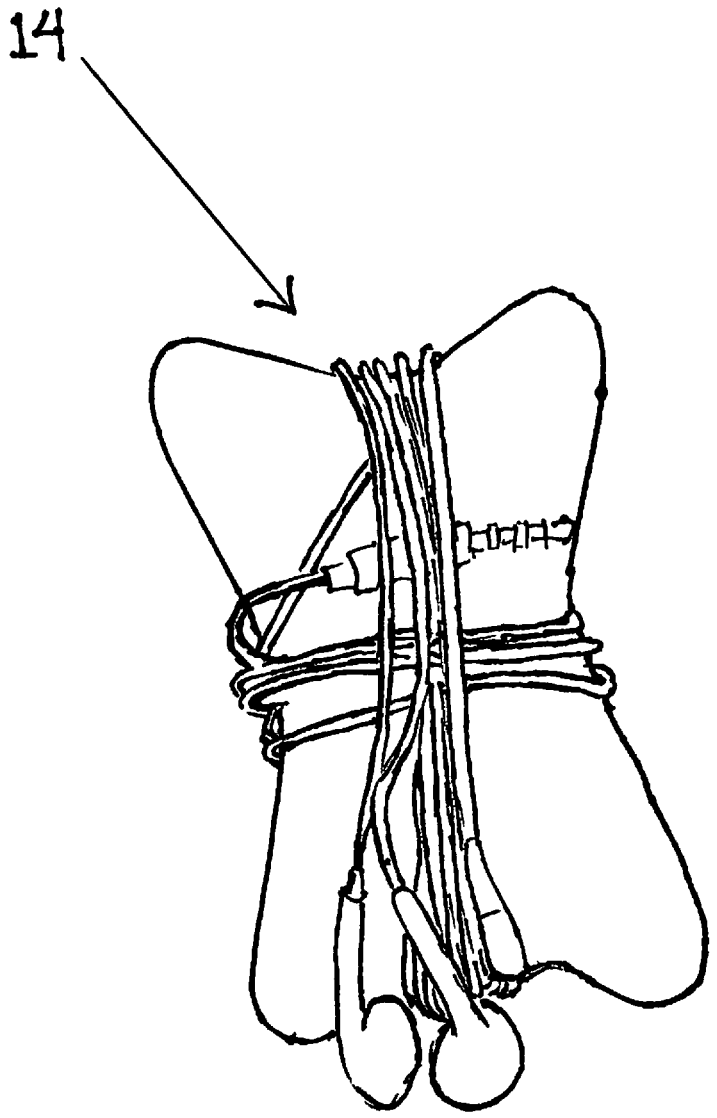
FIG. 6 illustrates an embodiment of the present invention in accordance with some embodiments, showing the headphone/earphone assembly including the wire and micro jack phono plug end and earphone components, and illustrates Part Two of one embodiment of the method or system of cord wrapping around the earphone holder.
Figure 7:
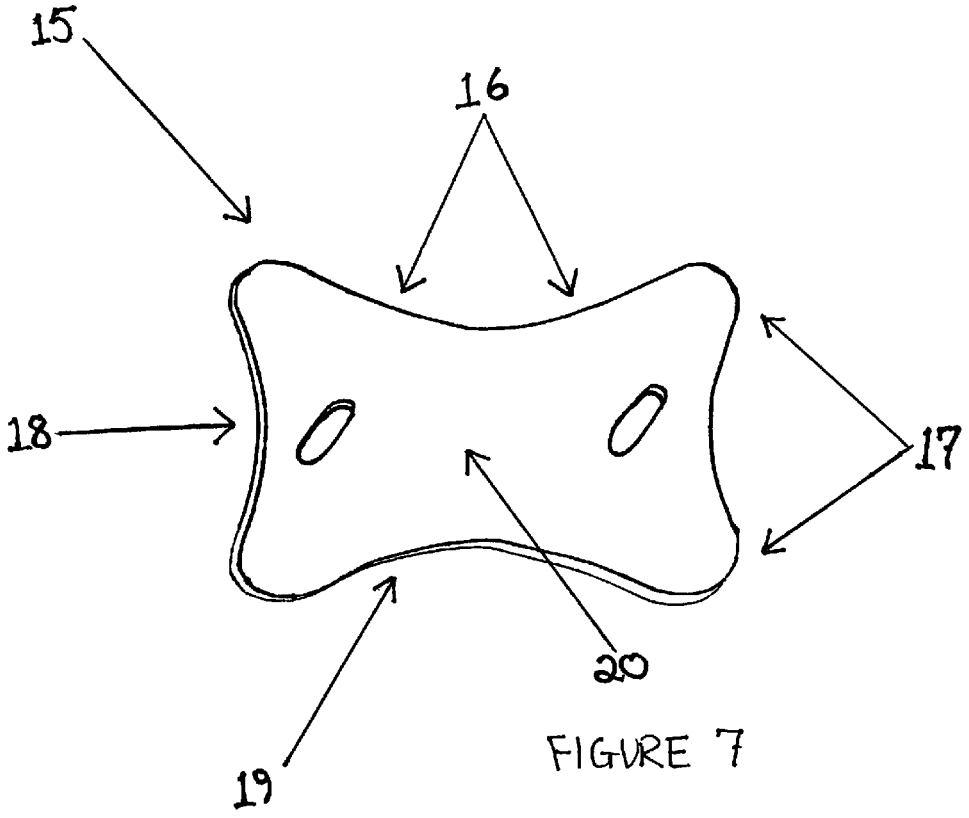
FIG. 7 illustrates another embodiment of the present invention in accordance with some embodiments and related variations.

V. The method or system of best use (best mode) as contemplated in the present invention includes the following contemplated manner of utilization to best facilitate the functionalities of cord coupling, cord wrapping, and cord unwrapping. While some variation in this manner of utilization is contemplated and expected, the method or system as described is an integral part of the present invention, and variations will not or should not detract from or the present invention as claimed. The method or system as claimed in this disclosure is comprised of (1) one or more methods for securely attaching to the cord; (2) one or more methods for wrapping the cord for tangle-free storage and transport, and (3) one or more methods for unwrapping the cord in the quickest and easiest possible manner, as follows:

VI. CORD ATTACHMENT PROCESS. One attachment is adapted to couple to the cord s best shown in FIGS. 3 and 4. The method or manner for cord attachment is described as follows: (Step 1) The untangled cord is passed through either of the two holes 9, using the smallest or narrowest portion of the cord's end-point; (The cord end used is normally the plug end, typically referred to as a "3.5 mm Mini Headphone plug" or a 2- or 3-conductor micro "Micro-Plug" "phone plug", or a Micro-USB plug end, or similar). (Step 2) an amount of cord is pulled through this hole to a length of 12" or more or less (depending on the user's preference). Then (Step 3) the cord is wrapped around the body of the object one or more times, or as shown in FIG. 3, with the same cord end being passed through the other hole 9 and tightened as shown 10. This method provides for quick attachment, simple adjustment or re-alignment, and a secure non-slip hold on the cord so the position of the object does not slip. CORD ATTACHMENT PROCESS (Continued). The method or manner for cord attachment as described in VI. above may alternatively be performed as shown in FIG. 4, where an alternate wrapping configuration is used. In this drawing, the cord 11 passes through the respective holes or openings 12 after making one (or more) rotations around the object body.

VII. CORD WRAPPING PROCESS. The method or manner for cord wrapping is described as follows: (Step 1) The plug end of the cord is wrapped in either direction around the middle of the object, as depicted at 13. The user may choose to hold this plug end down with a thumb as she/he proceeds to Step 2 below, so the plug end is secured by the wrapping below.

VIII. CORD WRAPPING PROCESS (Continued). The method or manner for completing cord wrapping is described as follows: (Step 2) The earbud or earphone end of the cord is wrapped in either direction around the length of the object, as depicted at 14. Once wrapping is completed, the user can simply put the integrated assembly and earbud holder object into a pocket, pouch or purse, or keep it wherever is most convenient and appropriate for the user. Some users may choose to place a rubber band over the loose earbud end or in some other way fasten it; however this is not necessary and is not a part of the object, method or system in this embodiment.

The method or manner for cord wrapping can be alternatively to wrap the earbud or earphone end of the cord FIRST, and then the plug- or prong-end is wrapped. This alternative enables the user to insert the plug into one of the provided holes or under the cord to secure the cord. Both wrapping processes are appropriate based on user preference. In yet another embodiment of the process and method of use, the user can wrap the cord longitudinally around the object only, particularly in cases where the cord is longer and/or in cases where the earphone elements are of the larger over-the-ear style; such method can aid in the speed of wrapping. Alternatively a horizontal-only winding may also be conducive, particularly for shorter cords. Other sequences or combinations are also acceptable. In any case, as a method of securing the cord, the earbuds or headphone components of the corded device (or portions of the associated cord itself) can be tucked under the previously wrapped cord to prevent unwanted unwinding.

IX. CORD UNWRAPPING PROCESS. It is noted in IX. above that the last portion of the cord assembly to be wrapped is the earbud or headphone end in this method. In this embodiment, the user grasps the two earbuds (R & L typically) in both hands and holds the integrated object assembly up while releasing any grasp on the object body, such that the cord begins to fall and commence to unwind based on the object's designed tendency to tumble in a rolling manner in accordance with the law of gravity and the relatively reduced friction inherent in the object's design, in part based on the combined weight of the integrated object and the properties of the uncoiling cord itself. The earbuds may be immediately placed in or on the ears as appropriate to their designed use. The cord will most frequently be found to be unwrapped, not tangled, and ready for use, at which point the plug end can be inserted into the electronic device to be used. The object of this disclosure will be found to remain attached to the cord as before, and can be worn in this way until the user wishes to discontinue use of the earbuds or headphones, at which point the user may proceed to wrap as before. The cord shall remain untangled when these simple process steps are followed.

X. Variations to standard embodiment. (A) In the infrequent occasions when the cord does not fully unwrap and extend for use, generally all that is required is a slight jiggling or pulling of the cord to fully unwrap the cord. (B) In some cases, users may want to most efficiently start using their wrapped earbuds, as in the case when the user is talking on their cellphone and want to switch to earbud/microphone mode with as little interruption to the ongoing conversation as possible. In this embodiment of the method and system of operation, the user would perform the following variation steps: (1.) Grasp the earbud or headphone side that corresponds to the user's ear which is not currently engaged in cellphone conversation, and place it in or on that ear. (i.e.—if the user is talking with the cellphone held with right hand to the right ear, the user grasps the L earbud and fits it properly in/on that ear.) (2.) The cord will be seen to unwind automatically from this point, as above. (3.) The plug end can be inserted into the phone jack on the cellphone, effectively switching the user conversation to the earbud speaker and microphone assembly. The other earbud can be inserted immediately or at any point the user chooses, and the conversation can continue uninterrupted.

XI. Variations to standard embodiment (continued). In another embodiment of the present invention, the object may be oriented in any of numerous orientations with respect to the cord and the user, as suggested at 15. In other embodiments of the present invention, the openings or holes previously discussed can appear in alternative forms or shapes within the planar surface, as in 16. In other embodiments of the present invention, the style and shape of the outer corners 17 may be more or less rounded. In these or still other embodiments of the present invention, the style and shape of the inner indented portions 18 and 19 may be more curved, or may alternatively include more straight edges. So long as the variations itemized in XIII remain within the parameters established in I, II, III, IV, and V above, the various embodiments are contemplated as a part of this present invention and do not diminish, detract or deviate from the design or functional process of the present invention as disclosed without limitation to the claims of the present invention.

XII. Imprinting options. An embodiment would allow a wearer of a pair of headphones or earbuds (or similar corded device) to display the ornamental object to others who are around the wearer. In one version, the attachment is substantially stable on the cord, sliding neither easily up or down the cord, but adjustable by the user. By displaying to others an ornamental object the user may be able to inform others what that person feels is important in life, and/or advertise specific information or branding content. As such, it is contemplated that both sides 20 the planar surface of the present invention may in some embodiments be used for messaging, advertising, content delivery, and/or color and style variations. For example, a logo or picture may be printed, through a screen printing process, on one attachment. Methods of imprinting may be by screen printing, pad printing, UV-LED or other ink printing, or laser etching, as examples. Phrases comprising alphanumeric characters may be used as well in an attachment. Since the two sides are in some embodiments able to be printed upon, and may be in the general size range of business cards, customized calling cards and the like, the present invention may in those embodiments display wide variations in the information, style, and colorations without limitation to the claims of the present invention.

In the preceding detailed description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The preceding detailed description, therefore, is not to be taken in a limiting sense, and the scope of the present invention is defined by the appended claims.

It is contemplated that features disclosed in this application, as well as those described in the above applications incorporated by reference, can be mixed and matched to suit particular circumstances. Various other modifications and changes will be apparent to those of ordinary skill.

The invention claimed is:

1. A method of storing an elongated cord having a first cord end and a second cord end, wherein the method comprises:

providing a cord storage device comprising a main body portion having a first aperture and a second aperture formed therein, wherein the main body portion comprises a first end, a second end, a first side edge and a second side edge, wherein the first side edge and the second side edge both extend between the first end and the second end, wherein the first aperture and the second aperture do not intersect the first end, the second end, the first side edge and the second side edge, wherein the first end and the second end both have a concave shape that extends between the first side edge and the second side edge, wherein the first side edge and the second side edge both have a concave shape that extends between the first end and the second end;

extending the first cord end through the first aperture;

wrapping the cord at least once around the main body portion before extending the first cord end through the second aperture to retain the main body portion in a substantially stationary position with respect to the cord;

wrapping the first cord end around the main body portion so that the cord extends over the first end and the second end; and wrapping the second cord end around the main body portion in a direction that is generally transverse to a direction in which the first end was wrapped around the main body portion so that the cord extends over the first side edge and the second side edge.

2. The method of claim 1, wherein the elongated cord comprises a speaker proximate the first cord end and a plug proximate the second cord end.

3. The method of claim 1, and further comprising tucking the second cord end under a portion of the cord that is wrapped around the main body portion to prevent the cord from unwrapping from around the main body portion.

4. The method of claim 1, wherein the first aperture is formed in the main body region proximate the first end and wherein the second aperture is formed in the main body region proximate the second end.

5. A method of storing headphones comprising a speaker, a cord and a plug, wherein the cord extends from the speaker and wherein the plug is attached to an end of the cord that is opposite the speaker, wherein the method comprises:

providing a headphone storage device comprising a main body portion having a first aperture and a second aperture formed therein, wherein the main body portion comprises a first end, a second end, a first side edge and a second side edge, wherein the first side edge and the second side edge both extend between the first end and the second end, wherein the first aperture and the second aperture do not intersect the first end, the second end, the first side edge and the second side edge, wherein the first end and the second end both have a concave shape that extends between the first side edge and the second side edge and wherein the first side edge and the second side edge both have a concave shape that extends between the first end and the second end;

extending the plug and a portion of the cord through the first aperture;

wrapping the cord at least once around the main body portion before extending the plug through the second aperture to reduce a length of the cord;

wrapping an end of the cord to which the speaker is attached around the main body portion so that the cord extends over the first end and the second end; and wrapping an end of the cord to which the plug is attached around the main body portion in a direction that is generally transverse to a direction in which the end of the cord to which the speaker is attached is wrapped around the main body portion so that the cord extends over the first side edge and the second side edge.

6. The method of claim 5, and further comprising tucking the plug under a portion of the cord that is wrapped around the main body portion to prevent the cord from unwrapping from around the main body portion.

7. The method of claim 5, wherein the first aperture is formed in the main body region proximate the first end and wherein the second aperture is formed in the main body region proximate the second end.

* * * * *